US005809841A

United States Patent [19]

Smith

[11] Patent Number: 5,809,841

[45] Date of Patent: Sep. 22, 1998

[54] VARIABLE POSITION DETENT MECHANISM FOR A CONTROL LEVER

[75] Inventor: David P. Smith, Joliet, Ill.

[73] Assignee: Caterpillar Inc., Peoria, Ill.

[21] Appl. No.: 731,679

[22] Filed: Oct. 17, 1996

[51] Int. Cl.[6] ..... G05G 5/06; G05G 1/04

[52] U.S. Cl. ..... 74/531; 74/523

[58] Field of Search ..... 74/471, 483 R, 74/488 B, 527, 531, 523; 273/148 B; 336/134

[56] References Cited

U.S. PATENT DOCUMENTS

| | | | |
|---|---|---|---|
| 2,903,663 | 9/1959 | Collina | 336/134 |
| 4,103,559 | 8/1978 | Kohler | 74/471 |
| 5,062,509 | 11/1991 | Carpenter et al. | 74/483 R |
| 5,309,783 | 5/1994 | Doolittle et al. | 74/523 |
| 5,522,277 | 6/1996 | Bollinger | 74/531 |
| 5,607,158 | 3/1997 | Chan | 273/148 B |
| 5,647,464 | 7/1997 | Snell et al. | 74/483 R |

*Primary Examiner*—Charles A. Marmor
*Assistant Examiner*—Marcus Charles
*Attorney, Agent, or Firm*—John W. Grant; J. W. Burrows

[57] ABSTRACT

A variable position detent mechanism for latching a control lever at an infinite number of operating positions includes a semi-circular member connected to a support so that its axis coincides with the pivot of the control lever. An electric detent coil is connected to the lever at a location adjacent the semi-circular member so that energizing the detent coil magnetically latches the lever to the semi-circular member.

5 Claims, 1 Drawing Sheet

VARIABLE POSITION DETENT MECHANISM FOR A CONTROL LEVER

TECHNICAL FIELD

This invention relates generally to a detent mechanism and, more particularly to a variable position detent mechanism capable of holding a lever at an infinite number of positions.

BACKGROUND ART

Joystick controls are commonly used on machines having a dual path hydraulic drive. Typically, movement of the joystick in a fore and aft direction controls the forward and reverse drive functions, while moving the joystick from side to side from the neutral position controls the steering function. The joystick is normally spring biased to return to the neutral position when the operator releases the joystick. Optionally, many joysticks used for implements have a detent mechanism to hold the joystick primarily in an extreme actuated position.

One of the problems encountered with the joysticks used for dual path hydrostatic drive machines is that even though the force exerted by the return spring of today's joystick controls is relatively light, such force contributes significantly to operator arm fatigue, particularly when the joystick is held in a forward or a reverse drive position for extended travel periods.

Another problem encountered therewith is such detents have heretofore been capable of only holding the joystick at a particular position. For various reasons, the operator may wish to operate the vehicle at a speed less than maximum speed and thus it would be desirable to be able to retain the joystick at various operating positions.

Finally, friction packs are often used to hold a lever at various positions. However the friction force required to hold the lever at the maximum actuated position makes lever modulation difficult. The friction pack force is hard to turn on and off and such devices are not suitable for levers that must be automatically returned to a neutral position before an engine is started.

The present invention is directed to overcoming one or more of the problems as set forth above.

DISCLOSURE OF THE INVENTION

In one aspect of the present invention, a variable position detent mechanism for a control lever connected to a support for pivotal movement about a pivot comprises a semi-circular member connected to the support and having an axis coinciding with the pivot of the control lever. An electric coil is connected to the lever and positioned adjacent the semi-circular member.

BEST MODE FOR CARRYING OUT THE INVENTION

Figure 1:
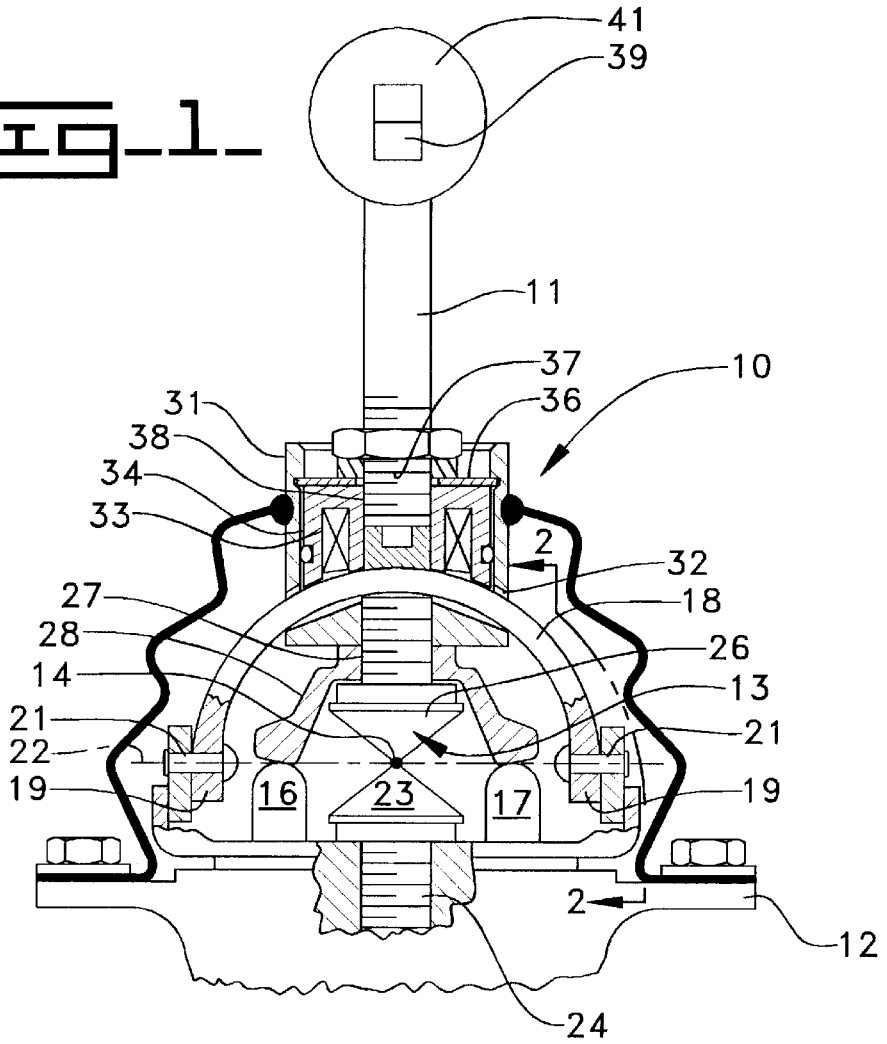
FIG. 1 is a cross-sectional view illustrating an embodiment of the present invention.
Figure 2:
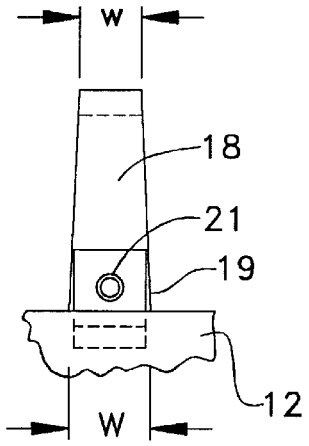
FIG. 2 is a view taken generally along line 2—2 of FIG. 1.
Figure 3:
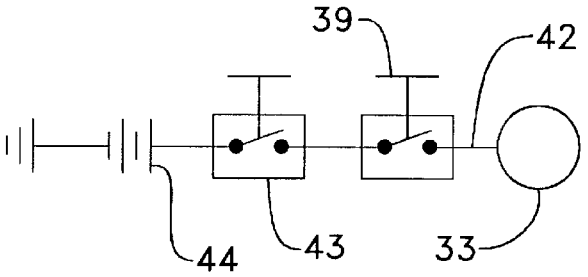
FIG. 3 is a schematic illustration of an electric circuit for the present invention.

A variable position detent mechanism 10 is shown in combination with a control lever 11 for retaining the control lever at an infinite number of actuated positions. The control lever in this embodiment is a joystick and is connected to a support 12 through a universal coupling 13 for pivotal movement about a pivot 14. The support can be, for example, a component of a pilot valve or an electrical control having a plurality of plungers, two of which are shown at 16,17 extending through the support on opposite sides of the universal coupling 13. The other two plungers are typically located at 90° from the plunger 16,17. The plungers are spring biased to the position shown for centering the control lever at a neutral position.

The detent mechanism 10 includes a semi-circular member 18 having opposite ends 19 pivotally connected to the support with a pair of axially aligned pivot pins 21 located having an axis 22 passing through the pivot 14.

The universal coupling 13 includes a first member 23 having a threaded portion 24 threadably engaging the support 12 and a second member 26 having a threaded portion 27 threadably engaging a bell shaped actuating member 28. The semi-circular member 18 has a variable width with the maximum width "W" being adjacent the ends 19 and the minimum width "w" being midway between the opposite ends.

The threaded portion 27 of the universal coupling 13 also threadably engages a cylindrical detent coil carrier 31 having an opening 32 which receives the semi-circular member 18. An electrical detent coil 33 is disposed within a pocket 34 in the carrier 31 in close proximity to the semi-cylindrical member 18 and is retained therein by a retaining ring 36. A threaded portion 37 of the lever 11 threadably engages a threaded hole 38 in the detent coil so that the lever 11, the carrier 31 and the actuator 28 pivot in unison about the pivot 14.

A toggle switch 39 is suitably mounted to a handle 41 at the distal end of the lever 11 and is connected to the detent coil 33 through a lead 42. The switch 39 is serially connected through another toggle switch 43 to a source of electrical energy such as a battery 44. The switch 43 can be, for example, an engine key switch or a parking brake switch such that the detent coil 33 is automatically de-activated and the lever 11 spring biased to its neutral position when the switch 43 is opened.

INDUSTRIAL APPLICABILITY

In use, the detent coil 33 is energized by closing the switch 39 when the switch 43 is closed. Energizing the detent coil creates an electromagnetic field to magnetically latch the lever and the detent coil to the semi-cylindrical member 18 and can be done at any operative position of the lever. To reset the lever at another operating position, the operator can open the switch 39 to de-energize the detent coil, thereby unlatching the lever from the semi-circular member so that the lever can be freely moved to the new operating position. The lever can be re-latched to the semi-circular member at the new position by closing the switch 39 to re-energize the detent coil. Optionally, the lever can be reset by physically overpowering the electrical latch force generated by the detent coil. Moreover, should the lever be latched in a operating position when the switch 43 is opened, the detent coil would be de-energized, allowing the return springs of the mechanism to return the lever to the neutral position. The variable width of the semi-circular member provides increased latch force as the detent coil moves toward either of the ends 19. This compensates for the increased spring force normally encountered as the lever moves toward its extreme actuated positions.

Other aspects, objects and advantages of the present invention can be obtained from a study of the drawings, the disclosure and the appended claims.

I claim:

1. A variable position detent mechanism adapted for use with a control lever connected to a support for pivotal movement about a pivot, the variable position detent mechanism comprising:

a semi-circular member connected to the support and having an axis coinciding with the pivot of the control lever; and an electric detent coil connected to the lever and positioned adjacent the semi-circular member to magnetically latch the lever and the detent coil to the semi-circular member when the detent coil is energized.

2. The variable position detent mechanism of claim 1 including a switch mounted on the lever and an electrical lead connecting the switch to the detent coil.

3. The variable position detent mechanism of claim 1 wherein the semi-circular member has a variable width.

4. The variable position detent mechanism of claim 3 wherein the semi-circular member has opposite ends connected to the support and the maximum width of the member is adjacent the opposite ends.

5. The variable position detent mechanism of claim 1 including a universal coupling connecting the control lever to the support wherein the pivot is the center point of the universal coupling, the opposite ends of the semi-circular member being pivotally connected to the support on an axis passing through the center point of the universal coupling.

* * * * *